United States Patent [19]

Simon et al.

[11] Patent Number: 4,537,316

[45] Date of Patent: Aug. 27, 1985

[54] MODULAR DISPLAY FOR CIGARETTE PACKS

[75] Inventors: Virgil S. Simon, Glenview; Marvin L. Adenau, Hoffman Estates; John S. Skalski, Hanover Park, all of Ill.

[73] Assignee: Thomas A. Schutz Co., Inc., Morton Grove, Ill.

[21] Appl. No.: 510,436

[22] Filed: Jul. 1, 1983

[51] Int. Cl.[3] ..... A47F 3/14

[52] U.S. Cl. ..... 211/133; 211/187

[58] Field of Search ..... 211/49 D, 88, 103, 133, 211/187, 190, 126, 107, 112; 220/23.4; 40/124; 248/220.4, 221.2, 221.1

[56] References Cited

U.S. PATENT DOCUMENTS

| | | | |
|---|---|---|---|
| D. 254,821 | 4/1980 | Rabas . | |
| 3,157,252 | 11/1964 | Tucker | 211/187 X |
| 3,221,429 | 12/1965 | Reuben et al. | 40/124 |
| 3,229,823 | 1/1966 | Hummer | 211/187 |
| 3,791,528 | 2/1974 | Brendgord . | |
| 3,851,936 | 12/1974 | Muller . | |
| 3,872,974 | 3/1975 | Anstatt . | |
| 4,228,903 | 10/1980 | Eckert | 206/45.16 X |
| 4,329,800 | 5/1982 | Shuman . | |

*Primary Examiner*—Ramon S. Britts
*Assistant Examiner*—Sarah A. Lechok
*Attorney, Agent, or Firm*—Wood, Dalton, Phillips, Mason & Rowe

[57] ABSTRACT

A modular retail counter display apparatus for merchandise, such as cigarettes, which is displayed and sold in small packages. Two identical trays may be connected to a column, either with a separate means supporting the column or with one or both trays supporting the column. A sign holder slides onto the top of the column and a ratchet engagement between the sign holder and the column permits a sign to be mounted at any desired height on the column. The trays may be connected to the column in vertically spaced relationship, or the trays may be secured together in end abutting relationship and connect to the column in a horizontal arrangement. Alternatively, the trays and column may be supported by means of a clamp assembly either upon a horizontal rail or upon a vertical pole.

22 Claims, 22 Drawing Figures

60
6.
40
50
22
24
20B
21
23b
20A
23a
42
46
49
45
41
47
28b
27
26
28a
29a
29
30
31
32
33
34
51
58
52
53
55
57
56
43a
62
63
64
61
25

MODULAR DISPLAY FOR CIGARETTE PACKS

BACKGROUND OF THE INVENTION

Companies that produce merchandise which is displayed and sold in small packages, such as cigarettes, chewing gum, candy bars and the like, are always interested in display apparatus which will accommodate their merchandise and an advertising message almost anyplace in a retail store. A very popular location for such apparatus is at a check-out counter of a supermarket, chain drug store or the like.

Such apparatus needs to be of a type which can be shipped knocked down and easily assembled in a retail store; and because of the numerous different types of locations in which such display apparatus must be placed, it is highly desirable for the apparatus to be readily adapted to any of a variety of different situations. Sometimes more space is available horizontally than vertically, and vice versa. Sometimes the shelving in a retail store has horizontal or vertical rails upon which a display apparatus may be mounted; or in other situations it may be possible to place such a display directly upon a check-out counter.

It is also desirable, of course, that the apparatus be reasonably attractive to the eye.

U.S. Pat. No. Des. 254,821 discloses a cigarette package display rack which is the closest thing to the present apparatus that is known to the inventors. Another type of device for a related purpose is disclosed in U.S. Pat. No. 4,109,707, issued Aug. 29, 1978.

Patents which illustrate assembly arrangements which are broadly similar to that of the present invention include U.S. Pat. Nos. 3,791,528, issued Feb. 12, 1974, and 3,669,035, issued June 13, 1972, both of which are systems that have containers with hooks on their back walls for mounting upon a post or other structure.

Patents which show racks or baskets that can be fastened together end-to-end, in some cases by means of dovetail connections, include U.S. Pat. Nos. 3,704,792, issued Dec. 5, 1972; 3,851,936, issued Dec. 3, 1974; 3,857,482, issued Dec. 31, 1974; 3,874,510, issued Apr. 1, 1975; 4,228,903, issued Oct. 21, 1980; and 4,291,882, issued Sept. 29, 1981.

Patents in which containers are secured to a surface by means of a pressure sensitive adhesive strip include U.S. Pat. Nos. 3,813,813, issued June 4, 1974, and 3,872,974, issued Mar. 25, 1975.

Finally, U.S. Pat. Nos. 3,981,599, issued Sept. 21, 1976, and 4,346,868, issued Aug. 31, 1982, illustrate adjustable ratchet connections between parts, and U.S. Pat. No. 4,329,800, issued May 18, 1980 expressly discloses a ratchet type adjustable mounting for a sign.

While some of the foregoing patents suggests bits and pieces of the apparatus of the present invention, none of them approaches the apparatus of the present invention for simplicity, convenience of assembly and installation, and versatility.

SUMMARY OF THE INVENTION

The present apparatus consists of a modular display for 30 packages of cigarettes, but it is quite apparent that the structure could be adapted to various other kinds of merchandise merely by changing the dimensions of the trays in which the merchandise is displayed.

Two identical trays are adapted to be connected to an upright column one above the other; or the two trays may be joined together in end abutting relationship and then connected to the column in a horizontal arrangement. The two trays connected end-to-end may stand upon a planar surface so the upright column which is connected to the trays serves only as a support for a sign. On the other hand, one tray may be on the planar surface with the other tray connected to the column thereabove; or the column may be mounted upon a separate platform so that it supports both trays above the platform, either one above the other or in an end abutting horizontal arrangement.

A sign holder makes a sliding engagement with the upper end portion of the column by means of depending legs which slidingly engage the column and have resiliently mounted ratchet tabs that engage in notches in the back of the column, so the sign may be positioned at various heights above the trays.

In addition, the column may be secured to a clamp assembly for attachment to a horizontal rail or to a vertical pole if there is no appropriate counter space to support the display.

The bottoms of the trays and the bottom of the platform are provided with pads of pressure sensitive adhesive so they may be adhered to a surface upon which they are supported, thereby eliminating the possibility of inadvertently upsetting the display apparatus.

THE DRAWINGS

DETAILED DESCRIPTION OF THE INVENTION

Figures 1, 2, 3:
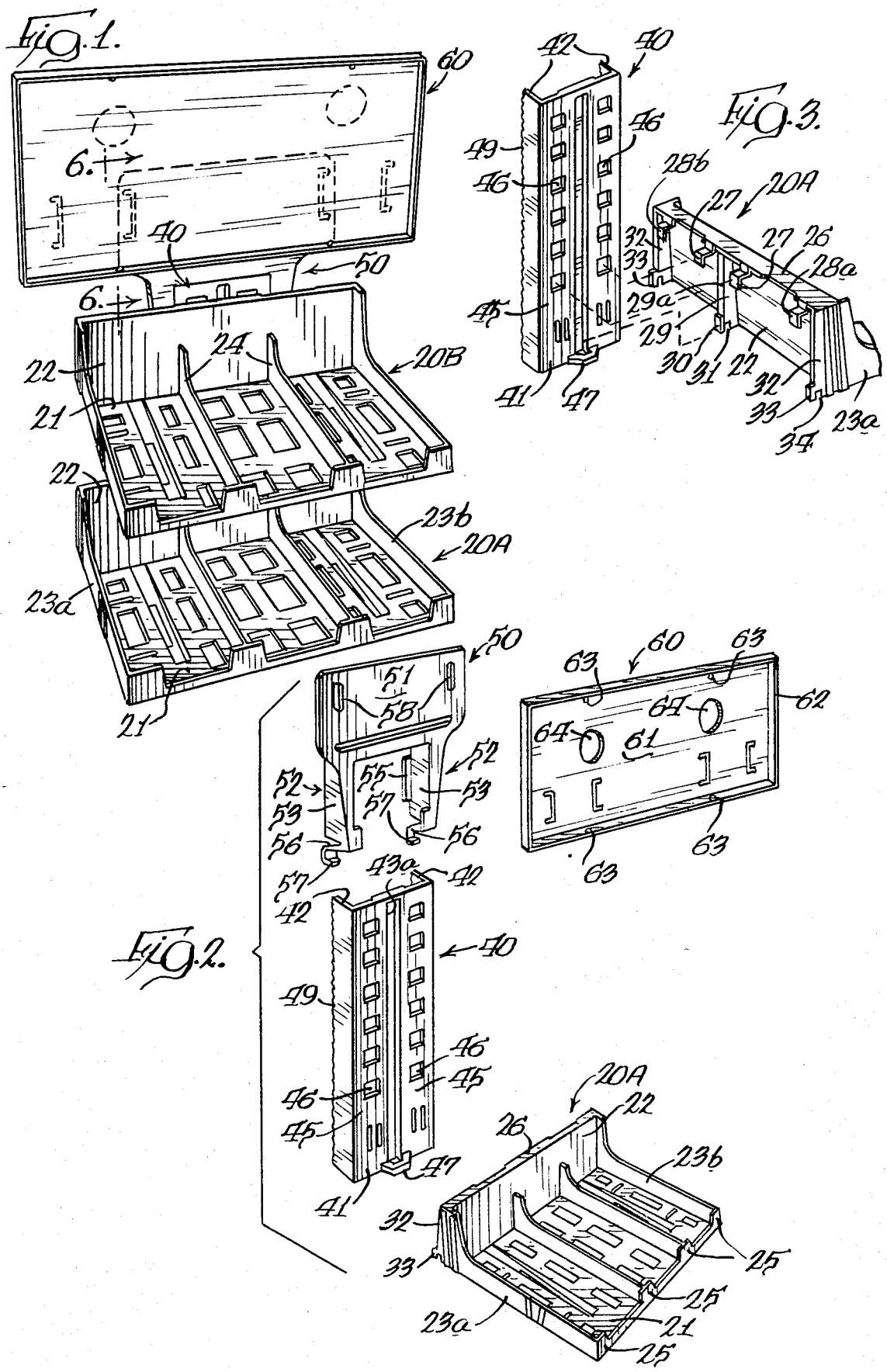
FIG. 1 is a perspective view of the apparatus of the invention with two trays connected to a column one above the other and the sign holder and sign mounted on the top of the column.
FIG. 2 is an exploded view of the lower tray, the column, the sign holder and the sign frame, with the upper tray omitted for clarity.
FIG. 3 is an exploded view illustrating the column and the back of the lower tray to show how they are connected.
Figure 4:
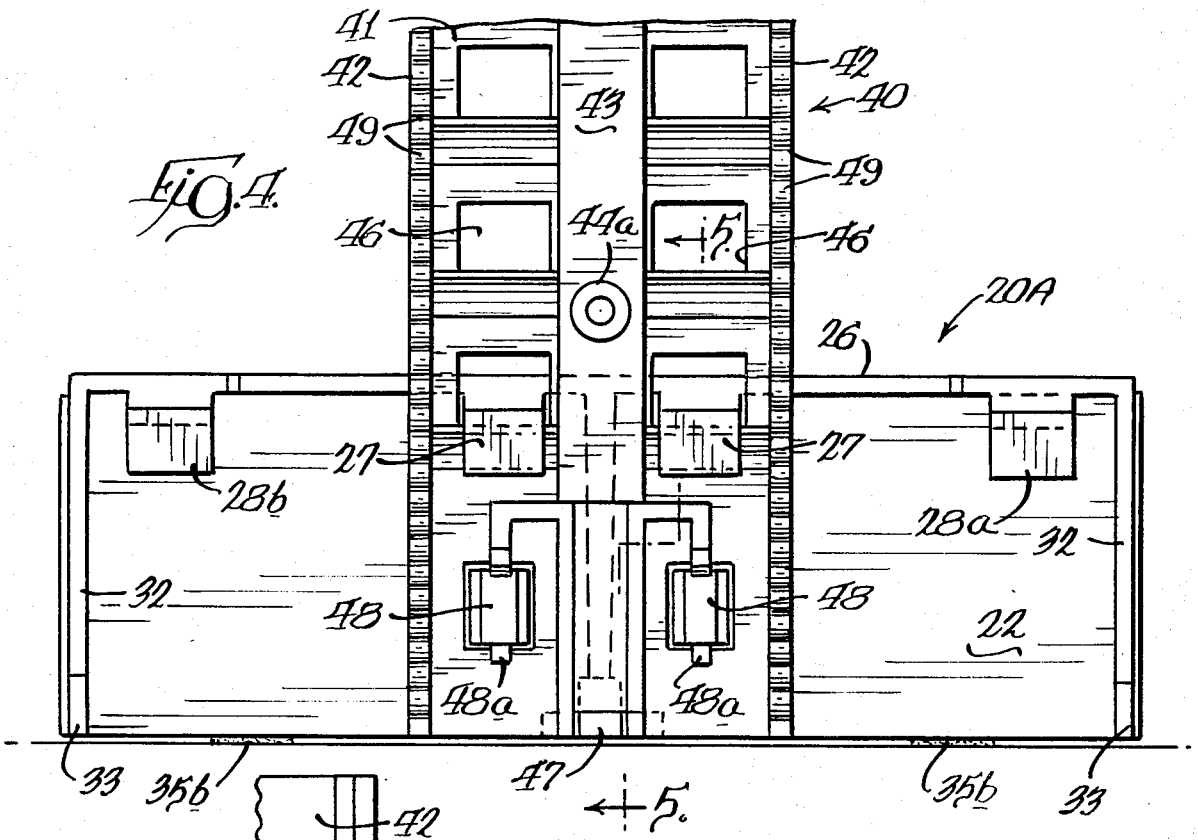
FIG. 4 is a fragmentary rear elevational view on an enlarged scale showing the connection between the bottom tray and the column.
Figure 5:
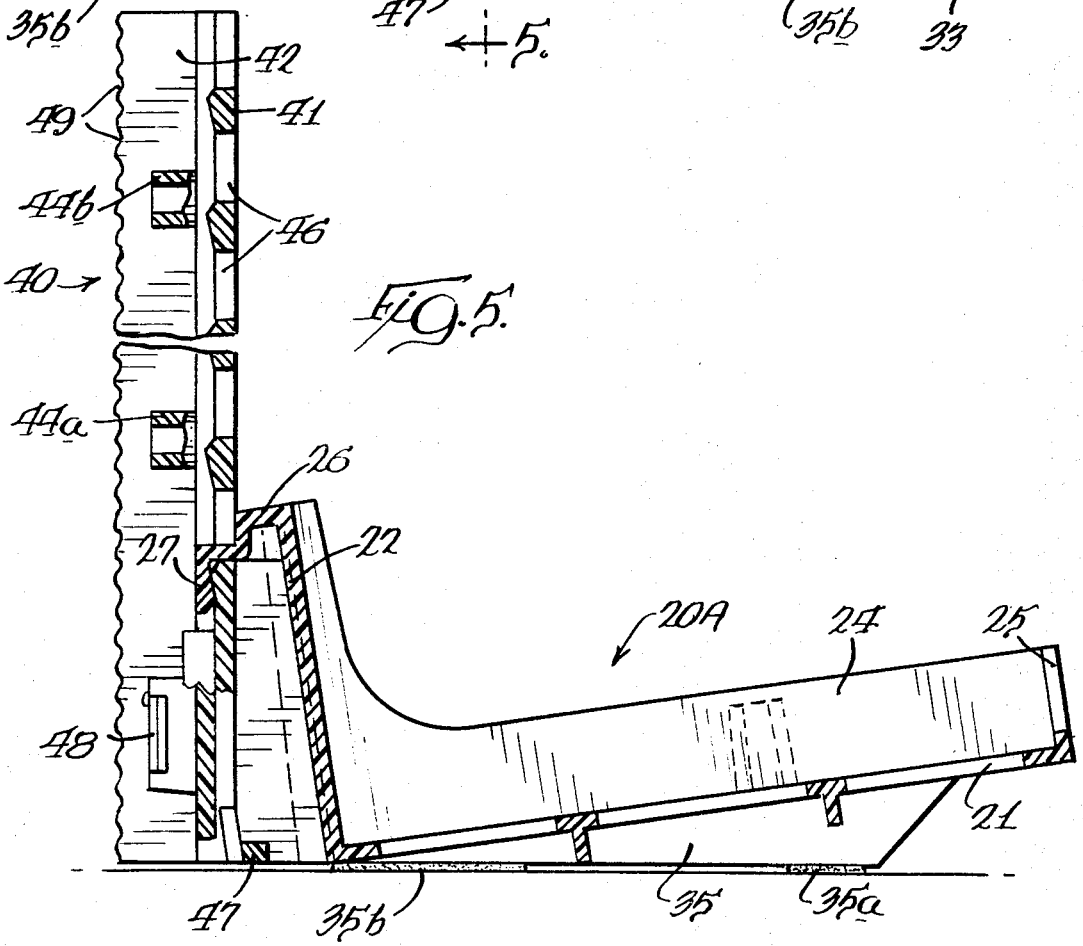
FIG. 5 is a sectional view taken substantially as indicated along the line 5—5 of FIG. 4.
Figure 6:
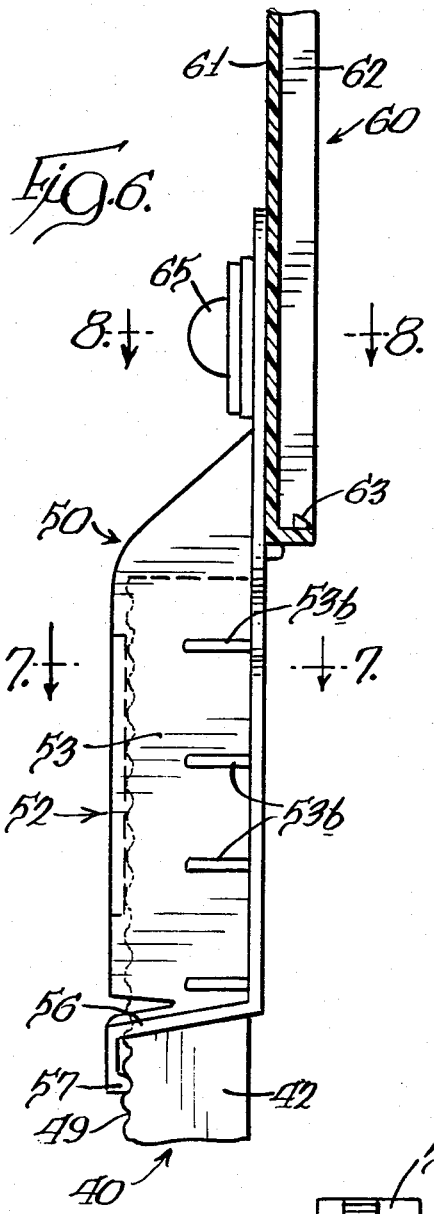
FIG. 6 is a fragmentary sectional view on an enlarged scale taken substantially as indicated along the line 6—6 of FIG. 1, illustrating the connection between the sign frame, the sign holder and the column.
Figure 7:
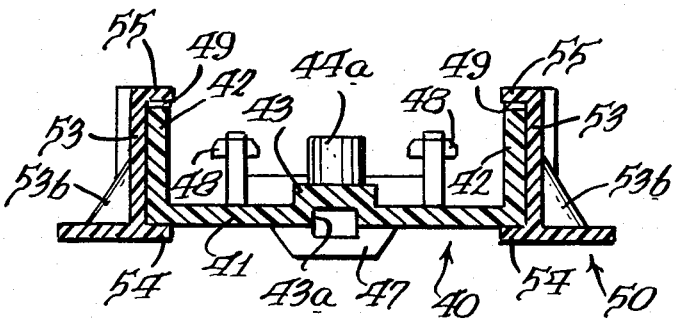
FIG. 7 is a sectional view taken substantially as indicated along the line 7—7 of FIG. 6.
Figure 8:
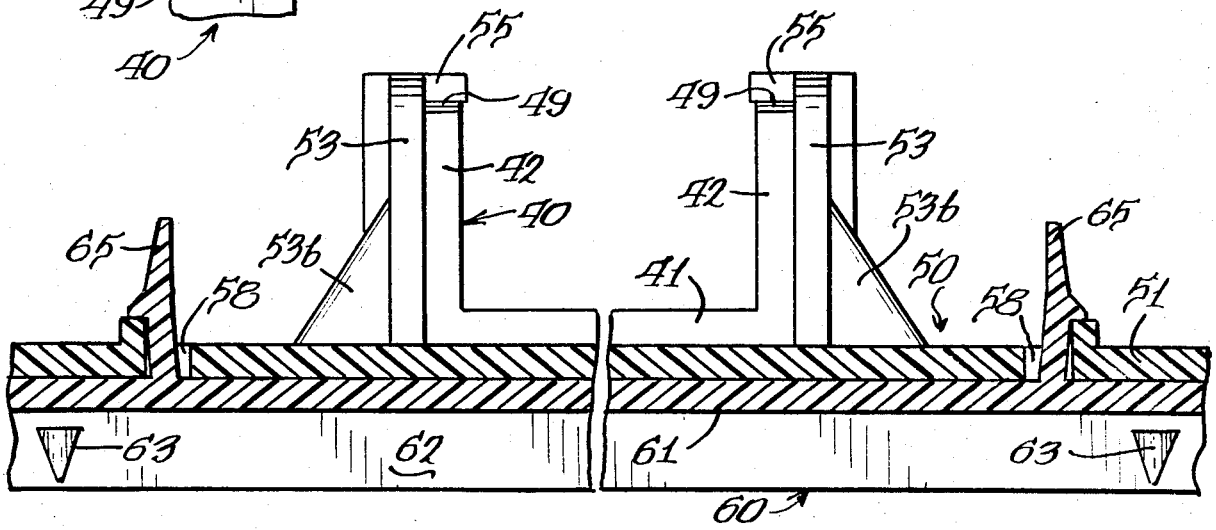
FIG. 8 is a fragmentary sectional view on an enlarged scale taken substantially as indicated along the line 8—8 of FIG. 6.
Figure 9:
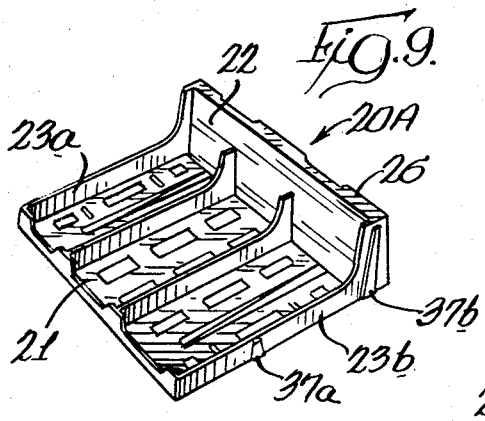
FIG. 9 is a perspective view of a tray viewed from one end.
Figure 10:
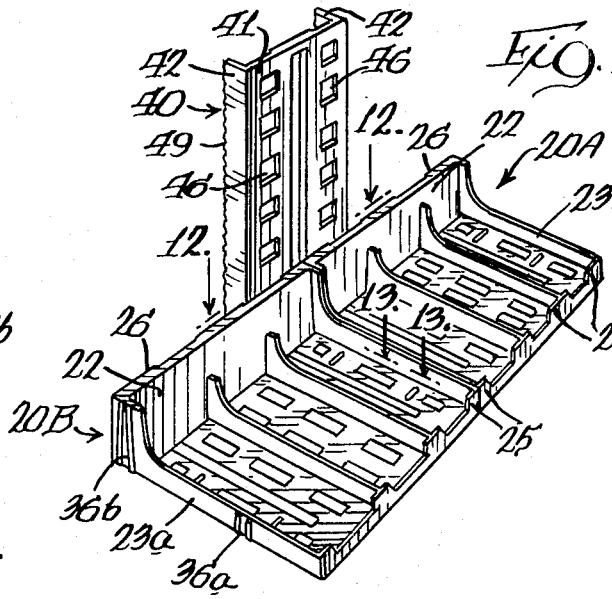
FIG. 10 is a perspective view of two trays connected together and connected to the column, taken from the opposite end from FIG. 9 so as to illustrate the male and female dovetail rnterconnecting means for the trays.
Figure 11:
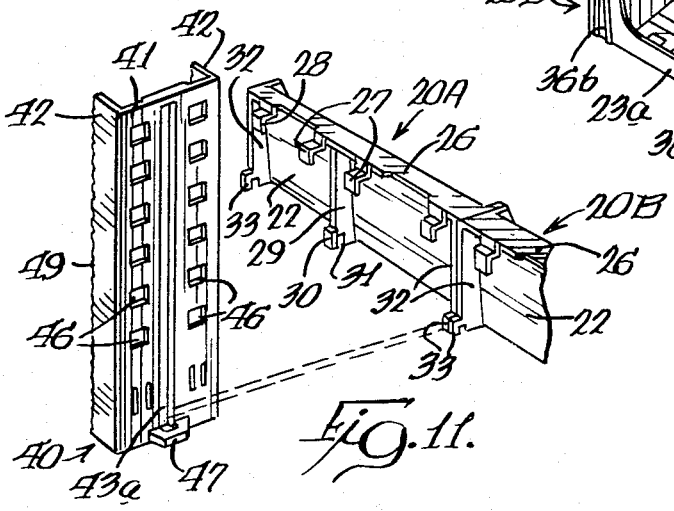
FIG. 11 is a fragmentary exploded view which is similar to FiG. 3, so as to illustrate the connection of the two interconnected trays to the column.
Figure 13:
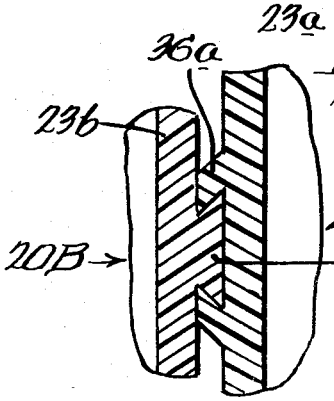
FIG. 13 is an enlarged fragmentary sectional view taken substantially as indicated along the line 13—13 of FIG. 10.
Figure 12:
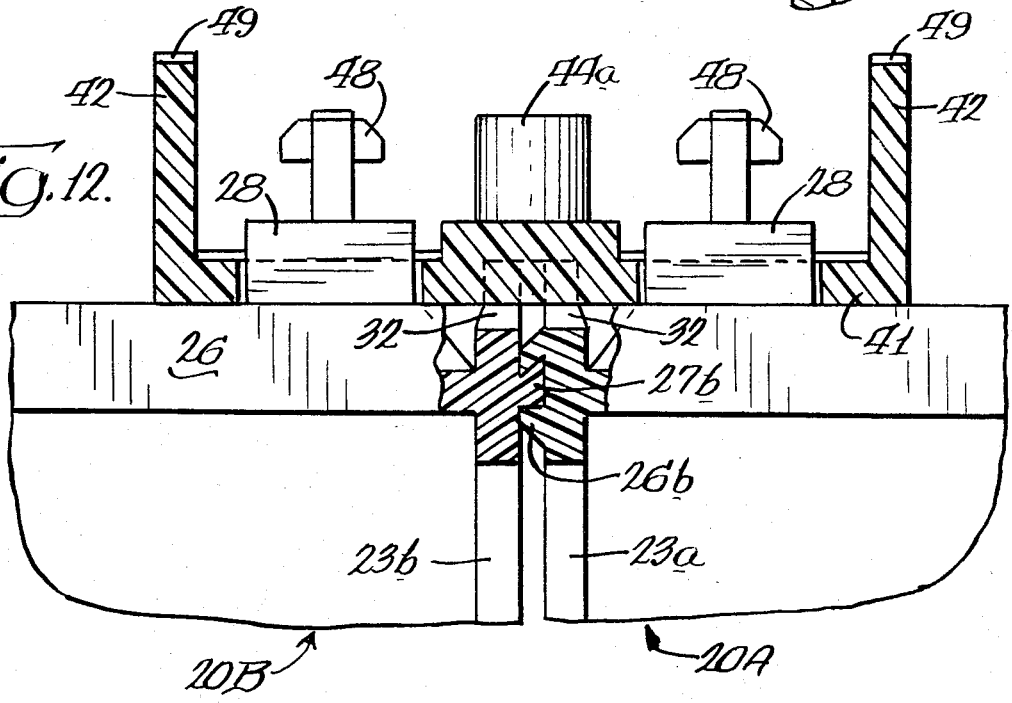
FIG. 12 is a fragmentary sectional view on an enlarged scale taken substantially as indicated along the line 12—12 of FIG. 10.
Figure 14:
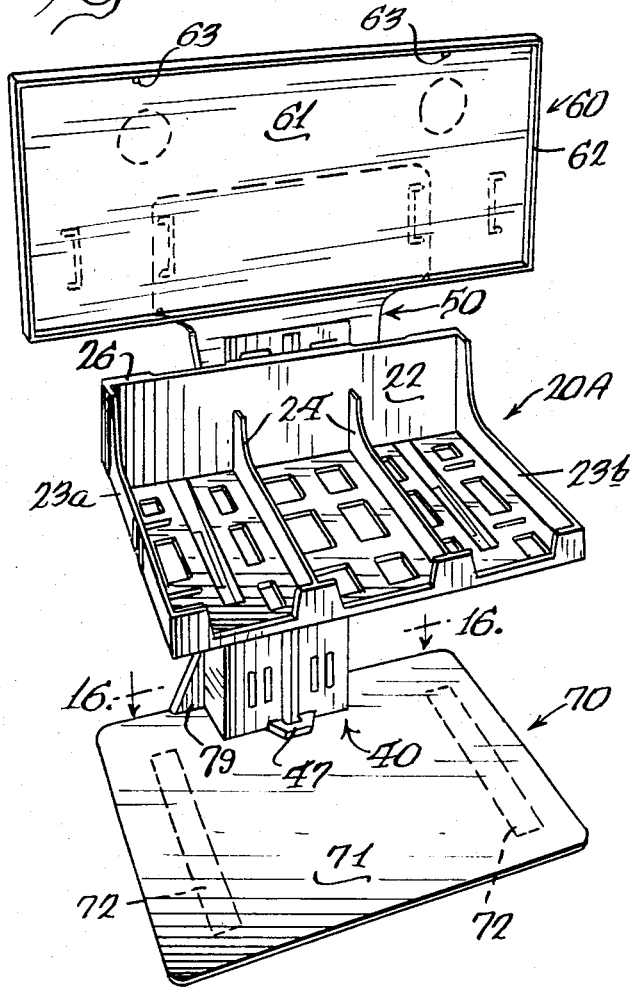
FIG. 14 is a perspective view illustrating the column mounted upon a platform with one tray connected to the column and the sign holder and sign frame in position.
Figure 15:
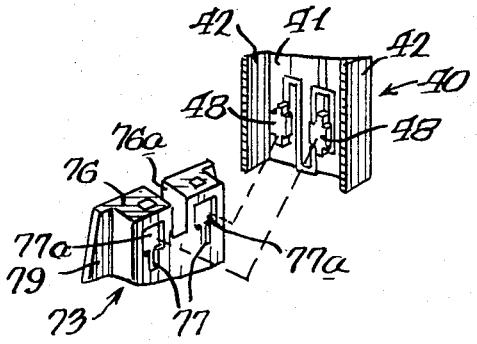
FIG. 15 is a fragmentary exploded view illustrating a mounting stub on the platform and the rear of the lower part of the column to show the interconnection between them.
Figure 17:
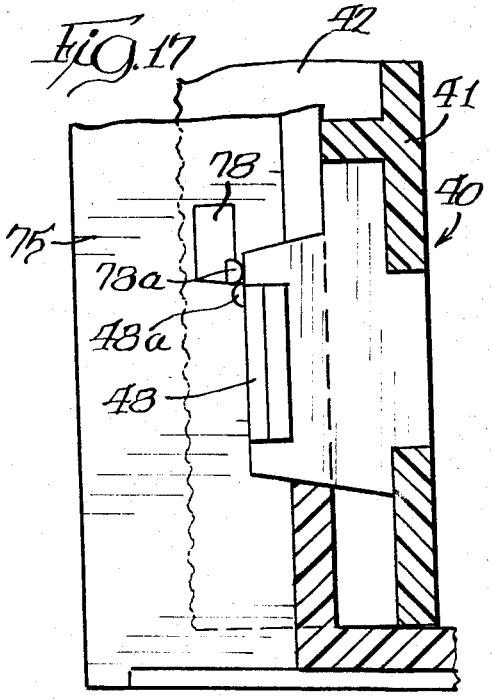
FIG. 17 is a sectional view taken substantially as indicated along the line 17—17 of FIG. 16.
Figure 16:
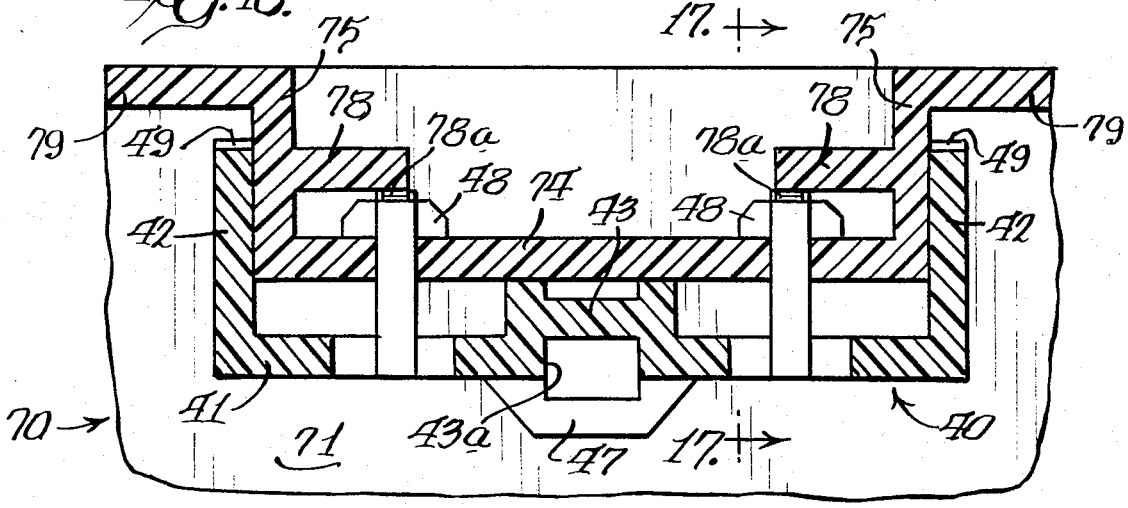
FIG. 16 is a fragmentary sectional view on an enlarged scale taken substantially as indicated along the line 16—16 of FIG. 14.
Figure 18:
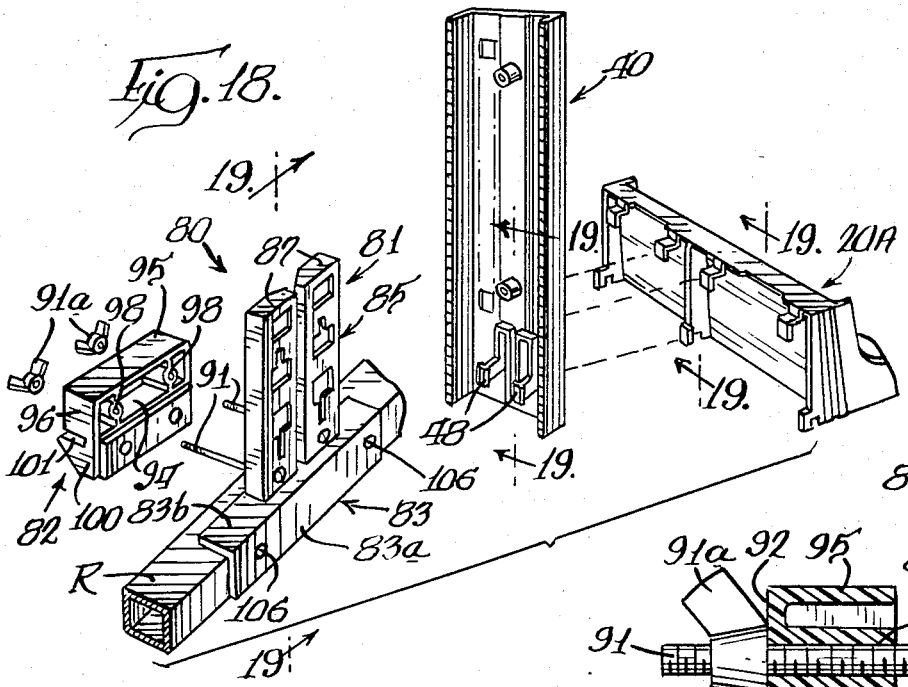
FIG. 18 is an exploded view of the components of the apparatus including a clamp illustrated for attachment to a horizontal rail.
Figure 19:
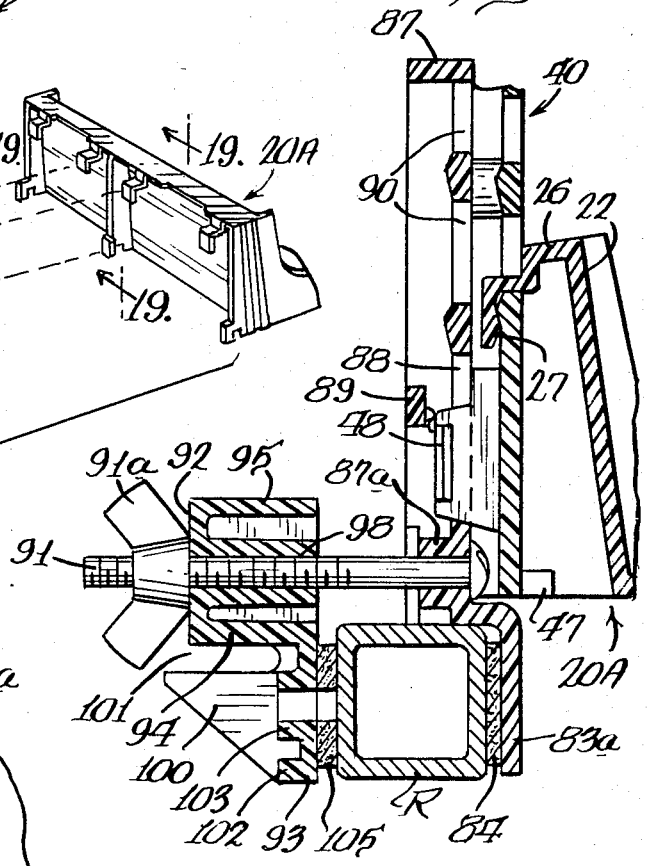
FIG. 19 is a fragment,ary sectional view on an enlarged scale taken substantially as indicated along the lines 19—19 of FIG. 18 with the parts assembled.
Figure 20:
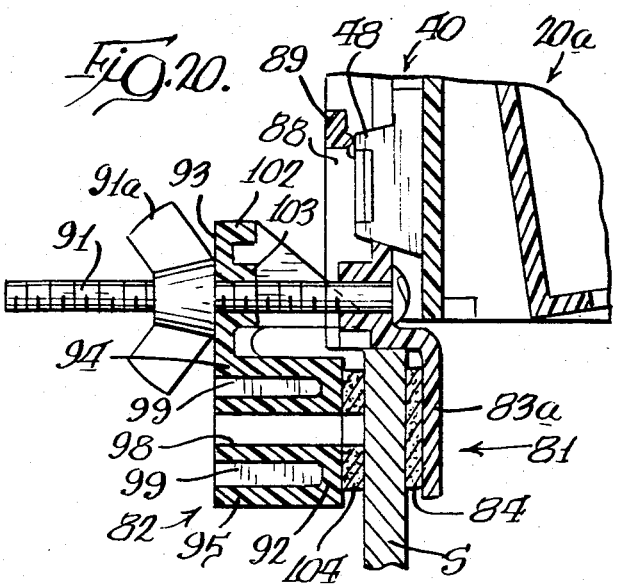
FIG. 20 is a fragmentary sectional view like a part of FIG. 19 illustrating the clamp secured to a structural member of smaller cross-section than the rail illustrated in FIGS. 18 and 29.
Figure 21:
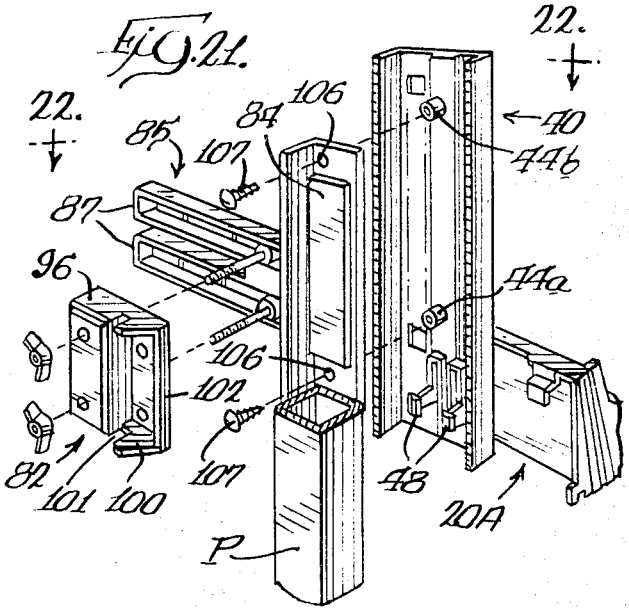
FIG. 21 is a view similar to FIG. 18 illustrating parts in relationship to a vertical post.
Figure 22:
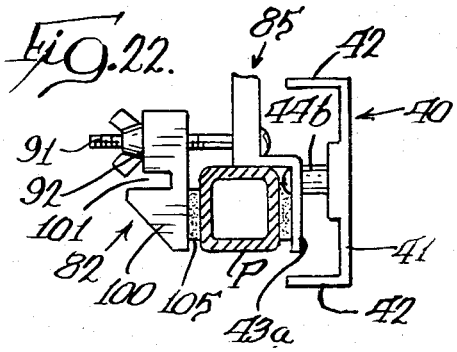
FIG. 22 is a fragmentary sectional view taken along the line 22—22 of FIG. 21 with the illustrated parts assembled.

Referring to the drawings in detail, the apparatus consists generally of two identical molded plastic trays, indicated generally at 20A and 20B; an upright column, indicated generally at 40; a sign holder, indicated generally at 50 and a sign frame, indicated generally at 60; and a platform, indicated generally at 70. Where the apparatus is to be mounted upon a horizontal rail R as illustrated in FIGS. 18–20, or upon a vertical pole a clamp assembly, indicated generally at 80 is used.

Each of the above-identified components, with the exception of the clamp assembly 80, consists of a one-piece plastic molding; and the clamp assembly consists of two molded plastic parts, plus threaded bolts and wing nuts to join the two parts of the clamp. When the mounting is upon a vertical pole, two screws are used to secure the column 40 to the clamp assembly 80.

Each of the two identical trays 20A and 20B consists of a lattice-like bottom wall 21, a rear wall 22, end walls **23*a* and 23*b*, partitions 24 parallel to the end walls, and front flanges 25 which extend transversely inwardly from the end walls 23 and transversely to both sides of the partitions 24**.

A rear ledge 26 extends a short distance rearwardly from the top margin of the rear wall 22, and on the rear ledge 26 are four integral, coplanar, downwardly open hooks consisting of two central hooks 27, and two flanking hooks **28*a* and 28*b* each of which is close to an end of the rear wall. Midway between the central hooks 27 is a rearwardly projecting median rib 29; and at the lower extremity of the median rib 29 is a rearwardly projecting rectangular lug 30 which projects transversely to both sides of the median rib and closes the back of a notch 31 which is in the lower rear extremity of the median rib. At the two ends of the rear wall 22, aligned with the tray end walls 23, are lateral ribs 32 each of which has a rearwardly projecting rectangular lug 33 at its lower end which is no wider than the rib and which closes the rear of a notch 34 which is aligned with the notch 31 in the median rib 29**.

Each tray has a base consisting of a pair of fore-and-aft extending base rails 35 which are adapted to rest stably upon a horizontal surface, and which are provided with pressure sensitive adhesive pads **35*a* toward the front and 35*b* toward the rear. The base rails 35 are seen to be deeper at the front than at the rear, so the bottom wall 21 of the tray is inclined rearwardly; and the median rib 29 and lateral ribs 32 have respective rear surfaces 29*a* and 32*a* which are normal to the plane of the bottoms of the base rail so that when a tray is connected to a column 40 the tray bottom wall 21** is also inclined relative to the column.

In order that the trays 20A and 20B may be fixedly joined together with the end wall **23*a* of the tray 20A abutting the end wall 23*b* of the tray 20B, each of the end walls 23*a* is provided with a forward female dovetail connection 36*a* and a rearward female dovetail connection 37*a*; and each of the end walls 23*b* is provided with a forward male dovetail connection 36*b* and a rearward male dovetail connection 37*b***, said dovetail connections interfitting to fixedly join the trays together.

When the trays are joined end-to-end, the lateral ribs 32 are in surface abutting relationship, as are the lugs 33 on the lateral ribs; and the space between the flanking hook **28*a* on the tray 28 and the flanking hook 28*b* on the tray 20B is substantially equal to the space between the central hooks 27**.

Referring now to the column 40, said column is in the form of a modified channel member which has a front wall 41 and two rearwardly extending sidewalls 42. Midway between and parallel to the sidewalls 42 is a rearwardly extending rib 43 the front of which is longitudinally recessed to define a slot **43*a*. On the rear of the rib 43 are internally threaded bosses 44*a* and 44*b* which are used when the column 40 is to be secured to the clamp assembly 80** by means of screws.

In the front wall 41 of the column 40 are two vertical rows 45 of horizontally aligned openings 46. The space between the openings 46 coincides with the space between the central hooks 27 of a tray, or between the flanking hooks **28*a* of the tray 20A and 28*b* of the tray 20B when the trays are connected end-to-end. In addition the slot 44 is wide enough to slidably receive the median rib 29*a* or the two lateral ribs 32. At the lower end of the slot 44 is a bottom tab 47 behind which the lug 30 on the median rib or the lugs 33 on the lateral ribs fit, with the tab 47 received in the median rib notch 31 or the lateral rib notches 34**, as the case may be.

In the lower end portion of the rear of the column front wall 41 are keyhole tabs 48 for connecting the column to the platform 70, or to the clamp assembly 80, as will be described in detail hereinafter.

The rear surface of each of the column sidewalls 2 is provided with a vertical row of notches 49, and said notches in the sidewalls are aligned with one another.

The principal elements of the apparatus as so far described provide two alternative assemblies. In one assembly, a tray, for example the tray 20A, is connected to the lowermost part of the column 40 by engaging the central hooks 27 in the lowermost pair of openings 47 of the column and hooking the lug 30 on the median rib 29 behind the bottom tab 48 on the column. The tray 20A is then fixed to a horizontal surface by means of the adhesive pads **35*a* and 35*b* on the base rails 35, and the tray 20B is mounted upon the column 40 by engaging its central hooks 27 with openings 47 in the upright column which are any desired distance above the lowermost hooks. In the other arrangement, the trays 20A and 20B are secured together with the end wall 23***a* of the tray 20A abutting the end wall 23*b* of the tray 20B, and the flanking hooks 28*a* and *b* of the two trays are hooked into the lowermost openings 46 of the column 40 with the lugs 33 on the lateral ribs 32 engaged behind the bottom tab 47 of the column. The adhesive pads 35*a* and 35*b* on both trays may then be used to affix the two trays to a planar surface.

Turning now to the sign holder 50 and the sign frame 60, the holder comprises a panel 51 which has a pair of transversely spaced, depending legs 52 each of which is of a generally channel-like cross section with a side plate 53 and inturned front and rear webs 54 and 55, respectively, so the sign holder legs span the column 40. At the lower ends of the side plate 53 are resilient fingers 56 having ratchet tabs 57. Thus, the sign holder 50 may slide over the column 40 and be fixed in any desired position relative to the trays 20 by ratcheting engagement of the ratchet tabs 57 in the notches 49. Gussett plates 53*b* reinforce the legs 53.

The sign holder panel 51 is provided with a pair of spaced upright slots 58.

The sign frame 60 consists of a rectangular sign frame body plate 61 which is surrounded by a rim 62, and on the rim at the top and bottom of the side frame 60 are small, inwardly extending nibs 63 behind which an advertising sign of resilient material such as cardboard may be mounted. Finger holes 64 in the body plate facilitate removal of an advertising sign from the sign frame.

On the rear of the sign frame 60 is a pair of resilient spring tabs 65 which make a snap engagement within the panel slots 58 of the sign holder 50 to mount the sign frame upon the sign holder after which the assembly of the sign frame 60 and the sign holder 50 is mounted upon the column 40 as previously described.

As previously indicated, the platform 70 may be used as a supporting means for the column 40 when there is a reason to mount the two trays above a planar surface upon which the apparatus is to be located. The platform 70 consists of a large rectangular base plate 71 upon the underside of which are pressure sensitive adhesive pads 72 for anchoring the platform 70 upon a planar surface such as a shelf or counter. At the rear of the base plate 71 is a mounting stub, indicated generally at 73, which has a front wall 74, sidewalls 75, and a top wall 76 with a central recess 76*a*. In the front wall 74 of the mounting stub is a pair of keyhole-like openings 77 which flank the top wall recess 76*a;* and extending inwardly from the sidewalls 75 a short distance to the rear of upper parts 77*a* of the keyhole-like openings are lugs 78. Lateral abutments 79 flank the stub sidewalls 75 at the extreme rear of the platform base plate 71.

The column 40 is mounted upon the platform mounting stub 73 by inserting the keyhole lugs 48 of the column 40 in the upper parts 77*a* of the keyhole-like opening 77, and sliding the column downwardly until the keyhole lugs 48 are behind the lower portions of the keyhole-like openings where nibs 48*a* on the lugs 48 make a snap engagement beneath nibs 78*a* at the front lower margins of the lugs 78.

With the column 40 secured to the platform 70 as above described, the trays 20A and 20B may be mounted upon the column either in the vertically spaced arrangement or in the end abutting horizontal arrangement, as previously described; and the sign holder 50 and sign frame 60 may then be mounted upon the column as previously described.

Although not illustrated in the drawings, it is quite apparent that if desired a column extension might be provided to connect to the platform mounting stub 73, and the column 40 could be mounted upon the upper portion of the column extension if it were necessary to raise the trays 20A and 20B above merchandise upon a shelf on which the platform is supported.

In case it is necessary to mount the display apparatus upon a horizontal rail R as illustrated in FIGS. 18–20, or upon a vertical pole, a clamp assembly 80 is provided. The clamp assembly 80 consists of a mounting member, indicated generally at 81, and a clamp compression member, indicated generally at 82. In the illustrated horizontal rail mounting the clamp mounting member 81 may be used either to directly support the trays 20A and 20B or to support the column 40 which in turn supports the trays as will be described; while in the vertical pole mounting the clamp mounting member 81 supports the column 40, which in turn supports the trays 20A and 20B.

The clamp mounting member 81 includes an angle bracket 83 that has a first web 83*a* and a second web 83*b*. On the first web 83*a* is a pressure sensitive adhesive pad 84; while perpendicular to the second web 83*b* is a bifurcated mounting arm, indicated generally at 85.

The mounting arm 85 has two parallel fingers 87. In the lower extremities of the fingers 87 are keyhole-like openings 88 and lugs 89 which are functionally identical to the openings 77 and the lugs 78 in the platform mounting stub 73, so the keyhole lugs 48 on the rear of the column front wall 41 may be engaged with the mounting arm fingers 87. Above the keyhole-like openings 88 the fingers are provided with a pair of aligned openings 90 which are the same as the openings 46 in the column 40, so that the trays 20A and 20B may be assembled in end-to-end relationship and mounted directly upon the fingers 87.

In the fingers 87 below the keyhole openings 88 are holes behind which are hollow bosses 91 to receive rearwardly extending threaded screws which are preferably fixed to the clamp mounting member 81 by means of sheet metal nuts that are trapped between integral flanges that flank the rear of the hollow bosses 91.

The clamp compression member 82 is a plastic molding which has a first clamping wall 92 and a second clamping wall 93 which are in parallel planes and which extend in opposite directions from the two transverse margins of a center wall 94. Parallel to the center wall 94 is an outer wall 95 which extends from the first clamping wall 92 to the plane of the second clamping wall 93; and the ends of the center wall and the outer wall are joined by sidewalls 96. Thus, the first clamping wall 92, the center wall 94, the outer wall 95 and the sidewalls 96 define a box-like structure which is open toward the plane of the second clamping wall 93; and in the box-like structure are a pair of hollow bosses 98 which communicate with holes in the first clamping wall and are strengthened by connecting ribs 99 that are integral with the center wall 94 and the outer wall 95.

At the two sides of the second clamping wall 93 are triangular webs 100 which are in the plane of the sidewalls 96 and spaced a short distance from the center wall 94 so that they cooperate with the center wall to define slots 101. A strengthening flange 102 extends along the margin of the second clamping wall 93 remote from the center wall 94, and a pair of short hollow bosses 103 are formed on the second clamping wall 93 in communication with holes in the second clamping wall and overhanging the center wall 94. The space between the hollow bosses 98 and between the hollow bosses 103 is the same as the space between the threaded bolts 91 on the clamp mounting member 81.

Preferably a pressure sensitive adhesive pad 104 is on the first clamping wall 92 and a second pressure sensitive adhesive pad 105 is on the second clamping wall 93.

The construction of the clamp compression member 82 permits the clamp to be secured to a horizontal member or rail which is from $\frac{1}{8}''$ to $1\frac{1}{4}''$ thick. In either case, the adhesive pad 84 on the first web 83*a* of the angle bracket 83 is first adhered to one face of the member to which the clamp is to be connected. Then if the clamp is to be mounted upon a structure of a thickness from $\frac{1}{8}''$ to $\frac{1}{2}''$ the clamp compression member 82 has the holes and hollow bosses 103 of the second clamping wall 93 slid over the bolts 91 with the first clamping wall 92 facing the angle bracket web 83*a* so that the adhesive pad 104 may also be adhered to the member to which the clamp is connected. Wing nuts 91*a* are then screwed onto the bolts 91 to connect the clamp assembly 80 firmly to the structural member with the second web 83*b* of the angle bracket 83 received in the slots 101 at the two sides of the clamp compression member 82.

If the clamp is to be connected to a structural member from $\frac{1}{2}''$ to $1\frac{1}{4}''$ thick, the clamp compression member 82 is mounted with the hollow bosses 98 slid onto the bolts 91 and the second clamping wall 93 facing the structural member on the side opposite the first web 83*a* of the angle bracket 83; and the wing nuts 91*a* are then screwed onto the bolts 91 to clamp the rail or structural member between the angle member web 83*a* and the second clamping wall 93, and with the adhesive pad 105 adhered to the rail or structural member.

It is to be noted that near the two ends of the web 83*a* are holes 106; and the space between those holes is the same as the space between the threaded bosses 44*a* and 44*b* which are on the rear of the column front wall 41. If it is necessary to mount the assembly upon a vertical pole P or similar vertical structural member, the clamp assembly 80 is connected to the vertical pole exactly as heretofore described with respect to the mounting upon a horizontal rail or structural member, in which arrangement the fingers 87 on the mounting arm 85 of the clamp mounting member 81 extend horizontally to one side of the pole and are not used in the assembly. The column 40 is then positioned with the threaded bosses 44*a* and 44*b* aligned with the holes 106 in the web 83*a*, and a pair of screws are extended through the holes 106 and into the hollow bosses 44*a* and *b* to mount the column 40 upon the clamp mounting member 81. The trays 20A and 20B may then be mounted upon the column 40 in the usual way, and the column is topped by the sign holder 50 and sign frame 60.

The foregoing detailed description is given for clearness of understanding only and no unnecessary limitations are to be derived therefrom, as modifications will be obvious to those skilled in the art.

We claim:

1. A modular retail counter display apparatus for merchandise which is displayed and sold in small packages, said apparatus comprising, in combination:

a single column which has a front wall provided with transversely adjacent vertical rows of aligned openings which are spaced apart by a predetermined distance;

and a pair of trays, each of said trays having a rear wall, four integral, coplanar, downwardly open hooks extending rearwardly from each rear wall, a central pair of said hooks being spaced apart by said predetermined distance so they may hook into two aligned column openings, and there being a flanking hook adjacent each end of each rear wall and spaced from the adjacent end toward the central pair of hooks by one-half said predetermined distance, and interfitting connectors at the ends of the pair of trays for fixedly joining the trays together with their ends abutting and the flanking hooks adjacent said abutting ends positioned to hook into two aligned single column openings, whereby said trays may be selectively connected to the column either in vertically spaced relationship or in end-abutting horizontal arrangement in which the two trays are supported only on said single column.

2. The combination of claim 1 in which the column has a vertical slot between the rows of openings, there is a rearwardly projecting median rib on each rear wall between the central pair of hooks which engages in said slot, and there is a rearwardly projecting lateral rib at each end of each rear wall, two of said lateral ribs being in face abutting relationship when the trays are joined together and being adapted to engage in said slot.

3. The combination of claim 1 in which each tray has a base which is adapted to rest stably on a horizontal surface, and the column may be connected to a tray which is on a horizontal surface so as to provide an upright support on the rear of said tray.

4. The combination of claim 3 in which the column has laterally spaced, vertical rows of rearwardly facing notches, there is a sign holder, transversely spaced depending legs on the sign holder slidingly engage the column, and ratchet tabs on the legs resiliently engage said notches, whereby said sign holder may occupy any desired vertical position on the column.

5. The combination of claim 4 in which the column is a channel member which has a front wall and two rearwardly extending sidewalls, and the notches are on the rear of said sidewalls.

6. The combination of claim 1 in which the column has laterally spaced, vertical rows of rearwardly facing notches, there is a sign holder, transversely spaced depending legs on the sign holder slidingly engage the column, and ratchet tabs on the legs resiliently engage said notches, whereby said sign holder may occupy any desired vertical position on the column.

7. The combination of claim 6 in which the column is a channel member which has a front wall and two rearwardly extending sidewalls, and the notches are on the rear of said sidewalls.

8. A modular retail counter display apparatus for merchandise which is displayed and sold in small packages, said apparatus comprising, in combination:

a column which has a front wall provided with transversely spaced vertical rows of aligned openings, and transversely spaced vertical rows of rearwardly facing notches on the column;

means supporting said column in an upright position;

a tray which has a rear wall, a pair of integral, coplanar, downwardly open hooks extending rearwardly from said rear wall, said hooks being adapted to hook into two aligned column openings;

and a sign holder, transversely spaced, depending legs on said sign holder which slidingly engage the column, and ratchet tabs on said legs that resiliently engage said notches, whereby said sign holder may occupy any desired vertical position on the column.

9. The combination of claim 8 in which the column is a channel member which has a front wall and two rearwardly extending sidewalls, and the notches are on the rear of said sidewalls.

10. The combination of claim 8 in which the means supporting the column in an upright position comprises a second tray which has a rear wall, a pair of integral, coplanar, downwardly open hooks extending rearwardly from said rear wall, said hooks being adapted to hook into two aligned column openings; and a base on said tray which is adapted to rest stably upon a horizontal surface.

11. The combination of claim 10 in which the tray also has a base which is adapted to rest stably upon a horizontal surface, whereby either said tray or said second tray may be the means supporting the column in an upright position.

12. The combination of claim 8 which includes a second tray identical to said first tray, flanking hooks on the rear walls of both said trays which are identical to said pair of hooks, said flanking hooks being close to the two ends of said rear walls, and interfitting connectors at the ends of said tray and said second tray to fixedly join them together with their ends abutting and the flanking hooks adjacent said abutting ends positioned to hook into two aligned column openings, whereby said trays may be selectively connected to the column either in vertically spaced relationship or in a horizontal arrangement.

13. The combination of claim 12 in which the column has a vertical slot between the rows of openings, there is a rearwardly projecting median rib on each rear wall between the central pair of hooks which engages in said slot, and there is a rearwardly projecting lateral rib at each end of each rear wall, two of said lateral ribs being in face abutting relationship when the trays are joined together and being adapted to engage in said slot.

14. The combination of claim 8 in which the means supporting the column in an upright position comprises a platform with an integral upstanding stub, and interengaging means on the stub and the lower end portion of the column for fixedly connecting the column to the platform.

15. The combination of claim 8 in which the means supporting the column in an upright position comprises a clamp assembly which connects to a structural member, said clamp being adapted to be connected to the lower end of the column.

16. The combination of claim 15 in which the structural member is a horizontal rail, the clamp assembly includes a mounting member, and there are interengaging means on the mounting member and the lower end portion of the column for fixedly connecting the column to the clamp assembly mounting member.

17. A modular retail counter display apparatus for merchandise which is displayed and sold in small packages, said apparatus comprising, in combination:

a column which has a front wall provided with transversely spaced vertical rows of aligned openings and laterally spaced vertical rows of rearwardly facing notches on the column;

a pair of trays, each of said trays having a base which is adapted to rest stably on a horizontal surface, a rear wall, flanking hooks close to the ends of said rear walls, and interfitting connectors at the ends of the pair of trays for fixedly joining the trays together with their ends abutting and the flanking hooks adjacent said abutting ends positioned to hook into two aligned column openings, whereby the column may be connected to said pair of trays to provide an assembly that may stand on a counter;

and a sign holder, transversely spaced, depending legs on said sign holder which slidingly engage the column, and ratchet tabs on said legs that resiliently engage said notches, whereby said sign holder may occupy any desired vertical position on the column.

18. The combination of claim 17 in which the column is a channel member which has a front wall and two rearwardly extending sidewalls, and the notches are on the rear of said sidewalls.

19. A modular retail counter display apparatus for merchandise which is displayed and sold in small packages, said apparatus comprising, in combination:

a column which has a front wall provided with transversely spaced vertical rows of aligned openings and a vertical slot between the rows of openings;

and a pair of trays, each of said trays having a rear wall, four integral, coplanar, downwardly open hooks extending rearwardly from each rear wall, a central pair of said hooks being adapted to hook into two aligned column openings, and there being a flanking hook adjacent each end of each rear wall, a rearwardly projecting median rib on each rear wall between the central pair of hooks which engages in said vertical slot, interfitting connectors at the ends of the pair of trays for fixedly joining the trays together with their ends abutting and the flanking hooks adjacent said abutting ends positioned to hook into two aligned column openings, and a rearwardly projecting lateral rib at each end of each rear wall, two of said lateral ribs being in face abutting relationship when the trays are joined together and being adapted to engage in said slot whereby said trays may be selectively connected to the column either in vertically spaced relationship with their respective median ribs in the vertical slot or in horizontal arrangement with two face abutting lateral ribs in said vertical slot.

20. The combination of claim 19 in which each tray has a base which is adapted to rest stably on a horizontal surface, and the column may be connected to a tray which is on a horizontal surface so as to provide an upright support on the rear of said tray.

21. The combination of claim 19 in which the column has laterally spaced, vertical rows of rearwardly facing notches, there is a sign holder, transversely spaced depending legs on the sign holder slidingly engage the column, and ratchet tabs on the legs resiliently engage said notches, whereby said sign holder may occupy any desired vertical position on the column.

22. The combination of claim 21 in which the column is a channel member which has a front wall and two rearwardly extending sidewalls, and the notches are on the rear of said sidewalls.

* * * * *